US010883201B2

(12) United States Patent
Liang et al.

(10) Patent No.: US 10,883,201 B2
(45) Date of Patent: Jan. 5, 2021

(54) POLYTETRAFLUOROETHYLENE TEXTILE AND MANUFACTURING METHOD THEREOF

(71) Applicant: EVEREST TEXTILE CO., LTD., Tainan (TW)

(72) Inventors: Ching-Hai Liang, Tainan (TW); Huang-Shan Lin, Tainan (TW); Cheng-Hsuan Wu, Tainan (TW); Chih-Jui Lin, Tainan (TW)

( * ) Notice: Subject to any disclaimer, the term of this patent is extended or adjusted under 35 U.S.C. 154(b) by 0 days.

(21) Appl. No.: 16/705,412

(22) Filed: Dec. 6, 2019

(65) Prior Publication Data

US 2020/0115829 A1 Apr. 16, 2020

Related U.S. Application Data

(63) Continuation-in-part of application No. 15/813,177, filed on Nov. 15, 2017, now abandoned.

(51) Int. Cl.

| | |
|---|---|
| ***D02G 1/00*** | (2006.01) |
| ***D04B 19/00*** | (2006.01) |
| ***D03D 15/00*** | (2006.01) |
| ***D02G 3/04*** | (2006.01) |
| ***D04B 1/18*** | (2006.01) |
| ***D04B 1/16*** | (2006.01) |

(52) U.S. Cl.

CPC ..... *D02G 1/002* (2013.01); *D02G 3/045* (2013.01); *D03D 15/0044* (2013.01); *D04B 1/16* (2013.01); *D04B 1/18* (2013.01); *D04B 19/00* (2013.01); *D10B 2321/042* (2013.01); *D10B 2401/021* (2013.01); *D10B 2401/061* (2013.01)

(58) Field of Classification Search

CPC ... D04B 1/12; D04B 1/20; D04B 1/16; D04B 21/16; D04B 19/00; D02G 1/002

USPC ..... 28/218

See application file for complete search history.

(56) References Cited

U.S. PATENT DOCUMENTS 3,579,764 A * 5/1971 Kieffer ..... D06P 1/0004 28/218
4,005,569 A * 2/1977 Corbiere ..... D02G 1/002 57/246
4,064,214 A * 12/1977 Fitzgerald ..... D01F 6/12 264/147

(Continued)

FOREIGN PATENT DOCUMENTS

CN 103849988 A 6/2014
CN 105723022 A 6/2016

(Continued)

*Primary Examiner* — Danny Worrell

(57) ABSTRACT

A polytetrafluoroethylene textile and manufacturing method thereof is disclosed. a pretreatment process is performed on a plurality of polytetrafluoroethylene yarns. In the pretreatment process, a step of extending the polytetrafluoroethylene yarns are extended, the polytetrafluoroethylene yarns are knitted into a polytetrafluoroethylene fabric, the shape of the polytetrafluoroethylene fabric is fixed, and the polytetrafluoroethylene fabric are de-knitted into the polytetrafluoroethylene yarns with a plurality of knit-assisting parts. A second knitting process is performed to knit the polytetrafluoroethylene yarns and a plurality of artificial yarns together to obtain the polytetrafluoroethylene textile.

16 Claims, 8 Drawing Sheets

(56) References Cited

U.S. PATENT DOCUMENTS

| | | | | | |
|---|---|---|---|---|---|
| 4,137,615 | A * | 2/1979 | Webster | D02G 1/002 | 28/154 |
| 4,156,071 | A * | 5/1979 | Knox | D01F 6/62 | 528/308.2 |
| 4,327,464 | A * | 5/1982 | Hutcheson | D06B 11/0036 | 28/218 |
| 4,769,880 | A * | 9/1988 | Heinrich | D02G 1/002 | 28/218 |
| 2019/0231021 | A1* | 8/2019 | Hoying | A43B 1/04 | |
| 2020/0115829 | A1* | 4/2020 | Liang | D03D 15/0044 | |

FOREIGN PATENT DOCUMENTS

| | | | | |
|---|---|---|---|---|
| GB | 1387944 | A * | 3/1975 | D02G 1/002 |
| GB | 2063936 | A * | 6/1981 | D02G 1/002 |

* cited by examiner

POLYTETRAFLUOROETHYLENE TEXTILE AND MANUFACTURING METHOD THEREOF

CROSS-REFERENCE TO RELATED APPLICATION

This application is a continuation-in-part of U.S. patent application Ser. No. 15/813,177 filed Nov. 15, 2017 which claims priority of Taiwan Patent Application No. 105139002, filed on Nov. 25, 2016 and Taiwan Patent Application No. 105218114, filed on Nov. 25, 2016, in the Taiwan Intellectual Property Office, the content of which are hereby incorporated by reference in their entirety for all purposes.

BACKGROUND OF THE INVENTION

1. Field of the Invention

The present invention relates to a textile and a manufacturing method thereof, and more particularly relates to a polytetrafluoroethylene textile and a manufacturing method thereof.

2. Description of the Related Art

In recent years, people gradually pay attention to the importance of the outdoor leisure activities, exercise and fitness, and for sports dress, light and comfortable and other functional clothing have also been stressed. Therefore, this type of functional clothing has gradually become the mainstream of development. In general, the outdoor leisure clothing that makes the user feel comfortable usually has the characteristic of surface water repellency, that is, its material is hydrophobic and also has the characteristic of draining moisture of human body, that is, fabric with moisture absorbing and perspiration dissipation functions, which is needed for the current market demand.

In order to achieve the effects of waterproofing and moisture permeation of the fabric, it is usually used to coat the water repellent on the fabric or adhere the waterproof and moisture permeable film to the surface fabric by coating or affixing method. However, the water repellent is often merely coated over the surface of the fabric by coating the water repellent on the fabric. The water repellent will be easily lost due to friction after repeated use, external friction and washing, resulting in water repellent function decline and shortcomings of poor durability. The original permeability of the fabric is often damaged because too much amount of resin coating block the pores between the fabric yarns by using the affixing or lamination method to laminate the waterproof and moisture permeable film on the surface of the fabric, resulting in shortcomings of obstructing permeability of the fabric.

SUMMARY OF THE INVENTION

In view of the aforementioned problems of the prior art, one purpose of the present invention is to provide a polytetrafluoroethylene textile and a manufacturing method thereof so as to solve the problem of shortcomings of poor durability and permeability of the waterproof and moisture fabric manufactured according to the prior art.

In order to accomplish the preceding purpose, the present invention provides a method of manufacturing a polytetrafluoroethylene textile, comprising steps of performing a pretreatment process on a plurality of polytetrafluoroethylene yarns, wherein the pretreatment process comprises a step of extending the polytetrafluoroethylene yarns; a step of first knitting the polytetrafluoroethylene yarns into a polytetrafluoroethylene fabric, a step of fixing the shape of the polytetrafluoroethylene fabric and a step of de-knitting the polytetrafluoroethylene fabric such that the polytetrafluoroethylene yarns are provided with a plurality of knit-assisting parts; and performing a second knitting process to knit the polytetrafluoroethylene yarns with knit-assisting parts and a plurality of artificial yarns together to obtain the polytetrafluoroethylene textile, wherein the knit-assisting parts assist the second knitting process to knit the polytetrafluoroethylene yarns and the artificial yarns together.

Preferably, the length of the polytetrafluoroethylene yarns are increased in a proportion of 70% to 120% in the step of extending the polytetrafluoroethylene yarns.

Preferably, the shape of the polytetrafluoroethylene fabric is fixed by heating the polytetrafluoroethylene fabric.

Preferably, the shape of the polytetrafluoroethylene fabric is fixed by heating the polytetrafluoroethylene fabric at a temperature ranged from 230 to 260 Celsius degrees.

Preferably, the twisting value of knit-assisting parts of the polytetrafluoroethylene yarns is ranged from 150 to 650 TPI (Twist Per Inch).

Preferably, the knit-assisting parts of the polytetrafluoroethylene yarns are fluffy, curled and twisted in shape.

Preferably, the method further comprises performing a laminating process to laminate a water repellent fabric with the polytetrafluoroethylene textile together.

Preferably, the artificial yarns are selected from a group consisting of nylon yarns, polyester yarns and spandex yarns, the denier of the polytetrafluoroethylene yarns being within a range of from 40 to 400 denier, the denier of the nylon yarns being within a range of from 20 to 280 denier, the denier of the polyester yarns being within a range of from 20 to 300 denier, the denier of the spandex yarns being within a range of from 15 to 70 denier.

Preferably, a weight ratio of the nylon yarns to the polytetrafluoroethylene yarns is within a range of 25-45:55-75 if the artificial yarns are the nylon yarns, and a weight ratio of the polyester yarns to the polytetrafluoroethylene yarns to the spandex yarns is within a range of 50-65:34-40:1-10 if the artificial yarns is consisted of the polyester yarns and the spandex yarns.

In order to accomplish the preceding purpose, the present invention provides a polytetrafluoroethylene textile manufactured according to the foregoing method, comprising: an artificial structural layer comprising a plurality of artificial yarns; and a polytetrafluoroethylene structural layer comprising a plurality of polytetrafluoroethylene yarns, wherein the polytetrafluoroethylene yarns of the polytetrafluoroethylene structural layer and the artificial yarns of the artificial structural layer are knitted together, wherein the polytetrafluoroethylene structural layer has a plurality of knit-assisting parts that assist knitting of the polytetrafluoroethylene yarns and the artificial yarns together.

Preferably, the polytetrafluoroethylene textile, further comprises a water repellent structural layer disposed on the artificial structural layer, and wherein the water repellent structural layer and the polytetrafluoroethylene structural layer are disposed on two opposite sides of the artificial structural layer respectively.

Preferably, the twisting value of knit-assisting parts of the polytetrafluoroethylene yarns is ranged from 150 to 650 TPI (Twist Per Inch).

Preferably, the artificial structural layer is selected from a group consisting of nylon yarns layer, polyester yarns layer and spandex yarns layer.

Preferably, the denier of the polytetrafluoroethylene yarns is within a range of from 40 to 400 denier, the denier of nylon yarns of the nylon yarns layer is within a range of from 20 to 280 denier, the denier of polyester yarns of the polyester yarns layer is within a range of from 20 to 300 denier, the denier of spandex yarns of the spandex yarns layer is within a range of from 15 to 70 denier.

Preferably, a weight ratio of the nylon yarns layer to the polytetrafluoroethylene structural layer is within a range of 25-45:55-75 if the artificial structural layer is the nylon yarns layer, and a weight ratio of the polyester yarns layer to the polytetrafluoroethylene structural layer to the spandex yarns layer is within a range of 50-65:34-40:1-10 if the artificial structural layer is consisted of the polyester yarns layer and the spandex yarns layer.

In accordance with the preceding description, the polytetrafluoroethylene textile and the manufacturing method thereof of the present invention may have one or more following advantages:

(1) In the polytetrafluoroethylene textile and the manufacturing method thereof of the present invention, the polytetrafluoroethylene textile with characteristics of high durability and permeability can be manufactured by knitting the polytetrafluoroethylene yarns and the artificial yarns together.

(2) In the method of manufacturing the polytetrafluoroethylene textile of the present invention, the pretreatment process is performed before performing the knitting process (the second knitting process) to make the polytetrafluoroethylene yarns have the knit-assisting part to thereby facilitate knitting the polytetrafluoroethylene yarns and the artificial yarns together and confining the artificial yarns correspondingly. Therefore, the structure of the polytetrafluoroethylene textile manufactured by the method of the present invention is strong.

(3) In the polytetrafluoroethylene textile and the manufacturing method thereof of the present invention, the abilities of waterproofing and moisture permeation of the polytetrafluoroethylene textile can be improved by performing the laminating process to laminate the water repellent fabric with the polytetrafluoroethylene textile together.

(4) In the polytetrafluoroethylene textile and the manufacturing method thereof of the present invention, the manufactured polytetrafluoroethylene textile has excellent characteristics of moisture-proof, water resistance and water repellent by using specific materials and specifications of the artificial yarns.

For better understanding and knowledge of the technical features and attainable technical effects of the present invention, it is to be understood that the preferred embodiments and the accompanying detailed description are given hereinafter.

DETAILED DESCRIPTION OF THE INVENTION

Figure 1:
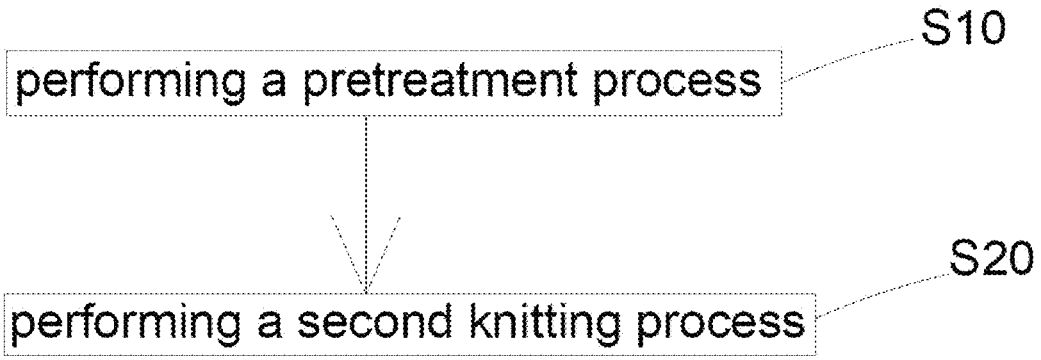
FIG. 1 is a schematic flow diagram of a first preferred embodiment of the method of manufacturing the polytetrafluoroethylene textile of the present invention.

For purposes of understanding the technical features, contents, advantages and technical effects achieved thereby, various embodiments of the present invention will now be described in more detail with reference to the accompanying drawings. Drawings are used for illustrating and assisting in understanding the detailed description, not represent the real scale and precise configuration of the present invention. Therefore, the claims cope of the subject matter are not interpreted or limited by the scale and configuration of the accompanying drawings. Further, for purposes of explanation, in the drawings, similar symbols typically identify similar components, unless context dictates otherwise.

Figure 2:
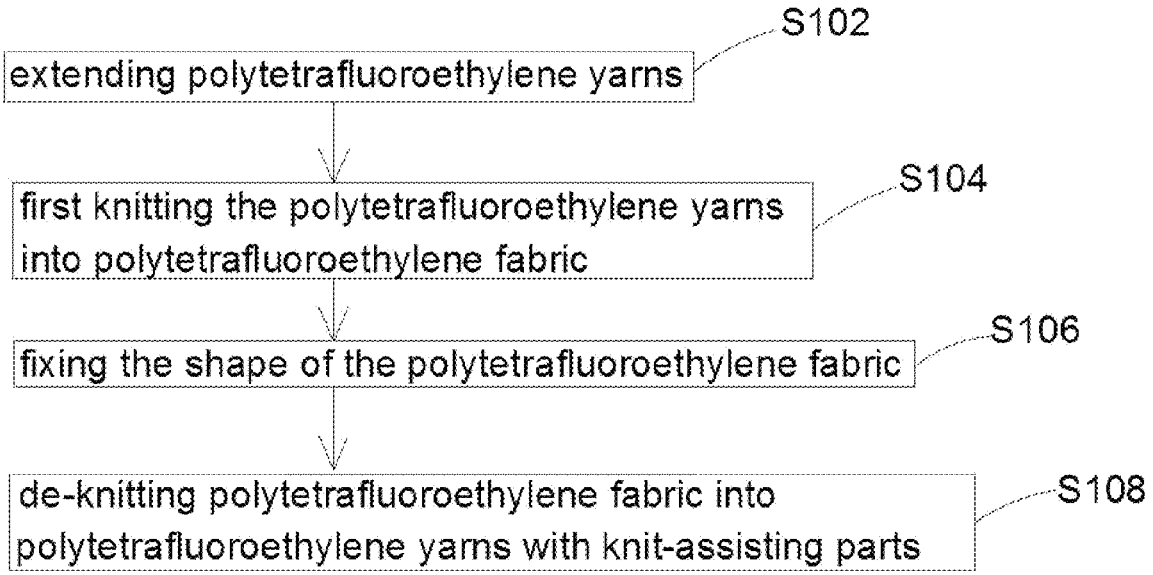
FIG. 2 is a schematic flow diagram of pretreatment process of the present invention.

Referring to FIG. 1 and FIG. 2, FIG. 1 is a schematic flow diagram of the first preferred embodiment of the method of manufacturing the polytetrafluoroethylene textile of the present invention, FIG. 2 is a schematic flow diagram of pretreatment process of the present invention. As shown in FIG. 1, the method of manufacturing a polytetrafluoroethylene textile of the present invention comprises at least the following steps of performing a pretreatment process (step S10) and performing a second knitting process (step S20). As shown in FIG. 2, in the step S10 of performing a pretreatment process, a step S102 of extending the polytetrafluoroethylene yarns is performed; a step S104 of first knitting the polytetrafluoroethylene yarns into a polytetrafluoroethylene fabric is performed; a step S106 of fixing the shape of the polytetrafluoroethylene fabric is performed; and a step S108 of de-knitting the polytetrafluoroethylene fabric into a plurality of polytetrafluoroethylene yarns is performed. The steps S102, S104, S106 and S108 are performed in sequence. The structures of the polytetrafluoroethylene yarns will be changed by the pretreatment process. Accordingly, after performing the pretreatment process, the polytetrafluoroethylene yarns can be provided with a plurality of knit-assisting parts. The knit-assisting parts of the polytetrafluoroethylene yarns have a twisting value, for example, ranged from 150 to 650 TPI (Twist Per Inch), but not limited thereto. The knit-assisting parts of the polytetrafluoroethylene yarns are fluffy, curled and twisted in shape.

In the step S102, the length of the polytetrafluoroethylene yarns are increased in a proportion of 70% to 120% in the step of extending the polytetrafluoroethylene yarns such that the cross sections of the polytetrafluoroethylene yarns approximately approach circles, and the surfaces of the polytetrafluoroethylene yarns become smooth and the diameters of the polytetrafluoroethylene yarns can be thereby adjusted. In the step S102, the length of the polytetrafluoroethylene yarns are increased by pulling and twisting. Optionally, the extending process can be performed at a temperature ranged from about 230 Celsius degrees to about 260 Celsius degrees. The polytetrafluoroethylene yarns are twisted to have a twisting value ranged from about 150 TPI to about 650 TPI. In the step S106, the shape of the polytetrafluoroethylene fabric is fixed by heating the polytetrafluoroethylene fabric, for example, at a temperature ranged from about 230 Celsius degrees to about 260 Celsius degrees.

As shown in FIG. 1, in the step S20, a second knitting process is performed to knit the polytetrafluoroethylene yarns and a plurality of artificial yarns together to obtain the polytetrafluoroethylene textile, wherein the knit-assisting parts that have a twisting value ranged from about 150 TPI to about 650 TPI can assist the second knitting process to knit the polytetrafluoroethylene yarns with the knit-assisting parts and the artificial yarns together. Moreover, the knit-assisting parts can be used to confine the artificial yarns correspondingly to thereby obtain the polytetrafluoroethylene textile. Accordingly, the step S10 and the step S20 are performed in sequence.

The manner for knitting the polytetrafluoroethylene yarns with the knit-assisting parts and the artificial yarns can be, for example, plain weave or chain stitch, but not limited thereto. Users can use the appropriate knitting or weaving manner to knit or weave the polytetrafluoroethylene yarns and the artificial yarns together depending on actual needs.

The polytetrafluoroethylene (PTFE) yarns can be manufactured, for example, by a split spinning method, an extrusion spinning method, a carrier spinning method or a melt spinning method, but not limited thereto. The polytetrafluoroethylene yarns claimed by the present invention can be all kinds the polytetrafluoroethylene yarns manufactured by all kinds of methods or manners for manufacturing the polytetrafluoroethylene yarns. The polytetrafluoroethylene yarns in the present invention are substantially free of other ingredients or impurities, that is, the composition of the polytetrafluoroethylene yarns are substantially 100% polytetrafluoroethylene. Or the polytetrafluoroethylene yarns can include other ingredients or impurities. Users can select and use the polytetrafluoroethylene yarns including or excluding other ingredients or impurities depending on actual needs. The denier of the polytetrafluoroethylene yarns are within a range of from 40 to 400 deniers, preferably 200 deniers, but not limited thereto. Users can use the polytetrafluoroethylene yarns with appropriate denier specification depending on actual needs.

The artificial yarns are also known as chemical yarns, which are the yarns manufactured by chemical method and include, but not limited to, polyester, nylon and spandex. In the present invention, the artificial yarns can be, for example, selected from a group consisting of nylon yarns, polyester yarns and spandex yarns. In one preferred embodiment, the artificial yarns is such as nylon yarns, polyester yarns or spandex yarns with single ingredient. In another preferred embodiment, the artificial yarns are such as yarns with composite ingredients. For example, the artificial yarns are the yarns comprising nylon and polyester ingredients; polyester and spandex ingredients; or nylon, polyester and spandex ingredients. The denier of the nylon yarns can be, for example, within a range of from 20 to 280 deniers, preferably 70 deniers, but not limited thereto. The denier of the polyester yarns can be, for example, within a range of from 20 to 300 deniers, preferably 75 deniers, but not limited thereto. The denier of the spandex yarns can be, for example, within a range of from 15 to 70 deniers, preferably 20 deniers, but not limited thereto. Moreover, in one preferred embodiment, the artificial yarns is the nylon yarns, and a weight ratio of the nylon yarns to the polytetrafluoroethylene yarns can be, for example, within a range of 25-45:55-75. In another preferred embodiment, the artificial yarns is consisted of the polyester yarns and the spandex yarns, and a weight ratio of the polyester yarns to the polytetrafluoroethylene yarns to the spandex yarns can be, for example, within a range of 50-65:34-40:1-10. Users can use the artificial yarns with appropriate ingredient(s) and specification depending on actual needs, and similarly, users can use the artificial yarns and the polytetrafluoroethylene yarns with appropriate content and ratio depending on actual needs.

Figure 3:
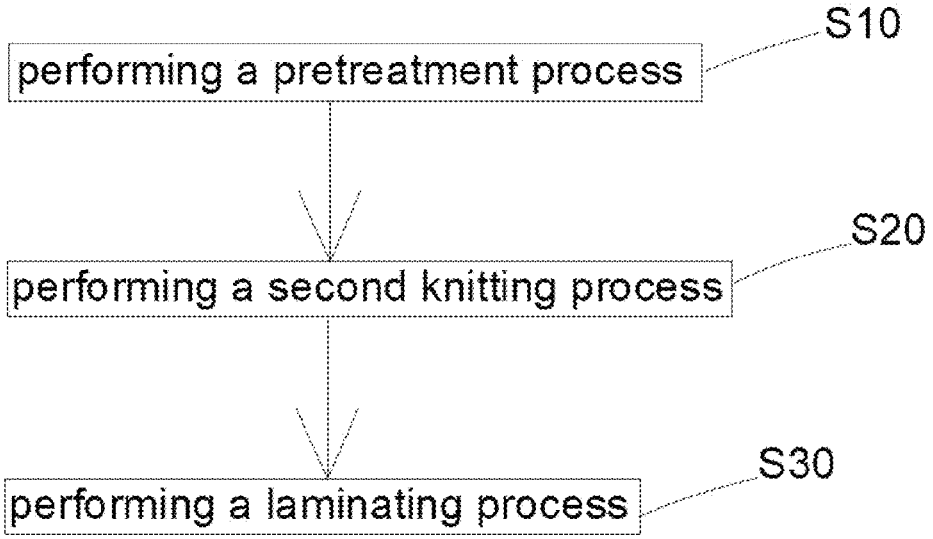
FIG. 3 is a schematic flow diagram of the second preferred embodiment of the method of manufacturing the polytetrafluoroethylene textile of the present invention.

Referring to FIG. 3, FIG. 3 is a schematic flow diagram of the second preferred embodiment of the method of manufacturing the polytetrafluoroethylene textile of the present invention. The difference between the second embodiment and the first embodiment of the present invention is merely that in the second embodiment, a laminating process S30 can be further performed to laminate a water repellent fabric with the polytetrafluoroethylene textile together. The laminating process S30 is performed after the second knitting process S20 to laminate the water repellent fabric with the polytetrafluoroethylene textile together. The material of the water repellent fabric can be, for example, polyethylene terephthalate (PET), but not limited thereto.

The water repellent fabric comprises a water repellent structure layer and a transparent membrane structure layer, wherein the material of the water repellent structure layer can be polyethylene terephthalate (PET), and the material of the transparent membrane structure layer can be polyurethane (PU), but not limited thereto. For example, the water repellent fabric and the polytetrafluoroethylene textile can be laminated together by the method of PU foam flame burning, PU wet glue spray paste or PUR hot melt adhesive paste. The foregoing mentioned laminating methods of the water repellent fabric and the polytetrafluoroethylene textile are listed only for exemplification, not for limitation. Users can use appropriate laminating methods to laminate the water repellent fabric and the polytetrafluoroethylene textile together depending on actual needs.

Figure 4:
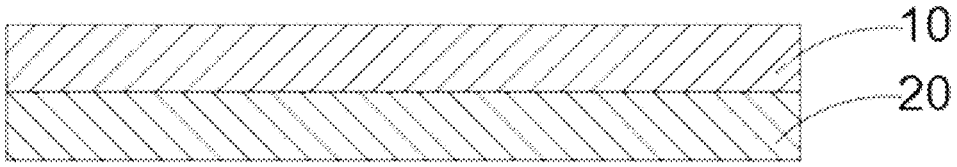
FIG. 4 is a side view diagram of the first preferred embodiment of the polytetrafluoroethylene textile of the present invention.

Referring to FIG. 4, FIG. 4 is a side view diagram of the first preferred embodiment of the polytetrafluoroethylene textile of the present invention. The polytetrafluoroethylene textile of the present invention can be, for example, manufactured by the aforementioned method of manufacturing a polytetrafluoroethylene textile. As shown in FIG. 4, the polytetrafluoroethylene textile can at least comprise an artificial structural layer 10 and a polytetrafluoroethylene structural layer 20. The artificial structural layer 10 can comprise a plurality of artificial yarns, and the polytetrafluoroethylene structural layer 20 can comprise a plurality of polytetrafluoroethylene yarns. And, the polytetrafluoroethylene yarns of the polytetrafluoroethylene structural layer 20 and the artificial yarns of the artificial structural layer 10 are knitted together. The polytetrafluoroethylene yarns of the polytetrafluoroethylene structural layer 20 and the artificial yarns of the artificial structural layer 10 can be knitted together by method of plain weave or chain stitch, but not limited thereto. Users can use the appropriate knitting or weaving manner to knit or weave the polytetrafluoroethylene yarns and the artificial yarns together depending on actual needs.

The artificial structural layer 10 can be, for example, selected from a group consisting of nylon yarns layer, polyester yarns layer and spandex yarns layer. And, the nylon yarns layer can comprise a plurality of nylon yarns, the polyester yarns layer can comprise a plurality of polyester yarns, and spandex yarns layer can comprise a plurality of spandex yarns. As mentioned above, in one preferred embodiment, the artificial structural layer 10 can comprise, for example, nylon yarns, polyester yarns or spandex yarns with single ingredient. In another preferred embodiment, the artificial structural layer 10 can comprise yarns with composite ingredients. For example, the artificial structural layer 10 can comprise, for example, nylon yarns and polyester yarns; polyester yarns and spandex yarns; or nylon yarns, polyester yarns and spandex yarns.

The denier of the polytetrafluoroethylene yarns can be, for example, within a range of from 40 to 400 deniers, preferably 200 deniers, but not limited thereto. Users can use the polytetrafluoroethylene yarns with appropriate denier specification depending on actual needs. The denier of nylon yarns of the nylon yarns layer can be, for example, within a range of from 20 to 280 deniers, preferably 70 deniers, but not limited thereto. The denier of polyester yarns of the polyester yarns layer can be, for example, within a range of from 20 to 300 deniers, preferably 75 deniers, but not limited thereto. The denier of spandex yarns of the spandex yarns layer can be, for example, within a range of from 15 to 70 deniers, preferably 20 deniers, but not limited thereto. Moreover, in one preferred embodiment, the artificial structural layer 10 is the nylon yarns layer, and a weight ratio of the nylon yarns layer to the polytetrafluoroethylene structural layer 20 can be, for example, within a range of 25-45:55-75. In another preferred embodiment, the artificial structural layer 10 is consisted of the polyester yarns layer and the spandex yarns layer, and a weight ratio of the polyester yarns layer to the polytetrafluoroethylene structural layer 20 to the spandex yarns layer can be, for example, within a range of 50-65:34-40:1-10. Users can use the artificial yarns with appropriate ingredient(s) and specification depending on actual needs, and similarly, users can use the artificial yarns and the polytetrafluoroethylene yarns with appropriate content and ratio depending on actual needs.

Figure 5:
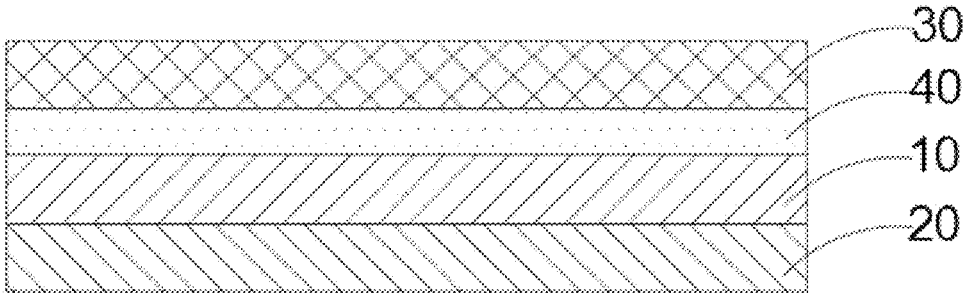
FIG. 5 is a side view diagram of the second preferred embodiment of the polytetrafluoroethylene textile of the present invention.

The polytetrafluoroethylene textile of the present invention can further comprise a water repellent structural layer. Referring to FIG. 5, FIG. 5 is a side view diagram of the second preferred embodiment of the polytetrafluoroethylene textile of the present invention. As shown in FIG. 5, the difference between the second embodiment and the first embodiment of the present invention is merely that the polytetrafluoroethylene textile in the second embodiment further comprise the water repellent structural layer 30 disposed on the artificial structural layer 10, and the water repellent structural layer 30 and the polytetrafluoroethylene structural layer 20 can be disposed on two opposite sides of the artificial structural layer 10 respectively. The water repellent structural layer 30 can be, for example, polyethylene terephthalate (PET) structural layer, but not limited thereto. In addition, a polyurethane (PU) structural layer 40 can be further disposed between the water repellent structural layer 30 and the artificial structural layer 10. As mentioned above, the water repellent structural layer 30, the polyurethane structural layer 40 and the artificial structural layer 10 can be laminated together by the method of PU foam flame burning, PU wet glue spray paste or PUR hot melt adhesive paste.

In one preferred embodiment, the artificial structural layer 10 of the polytetrafluoroethylene textile in the present invention comprises 70 denier nylon yarns layer, and the weight ratio of the nylon yarns layer to the 200 denier polytetrafluoroethylene structural layer 20 can be, for example, within a range of 25-45:55-75. Preferably, the weight ratio of the nylon yarns layer to the 200 denier polytetrafluoroethylene structural layer 20 can be 38:62 (weight per unit area is 213±3% g/sm, 0±3% g/y or 6.28±3% oz/sy). And, if the weight ratio of the nylon yarns layer to the 200 denier polytetrafluoroethylene structural layer 20 is 38:62, the number of the wear resistant revolutions of the polytetrafluoroethylene textile is 40,000. In addition, the water repellent structural layer 30 and the polyurethane (PU) structural layer 40 are further disposed on the artificial structural layer 10 of the polytetrafluoroethylene textile of the present invention. In this preferred embodiment, the overall polytetrafluoroethylene textile is a kind of three layers waterproof and moisture permeable swatch and has characteristics of water vapor resistance (Ret) equal to or smaller than 15 $Pa*m^2/W$, hydrostatic pressure equal to or larger than 15,000 $mmH_2O$, and water repellent effect equal to or larger than 80 after washing 20 times (AATCC 22). Water vapor resistance (Ret) is a fabric moisture-penetrable method, to measure water vapor penetration fabric input and output difference pressure.

In another preferred embodiment, the artificial structural layer 10 of the polytetrafluoroethylene textile in the present invention comprises 75 denier polyester yarns layer and 20 denier spandex yarns layer, and the weight ratio of the weight ratio of the polyester yarns layer to the 200 denier polytetrafluoroethylene structural layer 20 to the spandex yarns layer can be, for example, within a range of 50-65:34-40:1-10. Preferably, the weight ratio of the polyester yarns layer to the 200 denier polytetrafluoroethylene structural layer 20 to the spandex yarns layer can be 61:37:2 (weight per unit area is 247±5% g/sm, 0±5% g/y or 7.29±5% oz/sy). And, if the weight ratio of the polyester yarns layer to the 200 denier polytetrafluoroethylene structural layer 20 to the spandex yarns layer is 61:37:2, the number of the wear resistant revolutions of the polytetrafluoroethylene textile is 50,000. In addition, the water repellent structural layer 30 and the polyurethane (PU) structural layer 40 are further disposed on the artificial structural layer 10 of the polytetrafluoroethylene textile of the present invention. In this preferred embodiment, the overall polytetrafluoroethylene textile is a kind of three layers waterproof and moisture permeable swatch and has characteristics of water vapor resistance (Ret) equal to or smaller than 15 $Pa*m^2/W$, hydrostatic pressure equal to or larger than 15,000 $mmH_2O$, and water repellent effect equal to or larger than 80 after washing 20 times (AATCC 22).

The abrasion resistance test of the fabric is a test to measure the characteristic of abrasion resistance of the fabric. The abrasion resistance test of the fabric is performed by repeatedly rubbing the fabric with other objects and determined the damage content of the fabric such as broken yarns, holes, fade and so on during the using period. The abrasion resistance of the fabric can also be determined by the weight loss of the fabric after a certain amount of wear. Under the same conditions, the greater the weight loss, the worse the abrasion resistance of the fabric. Abrasion resistance is one of the important indicators of textile product quality, and will directly affect the durability and the using results of products.

Figure 6A:
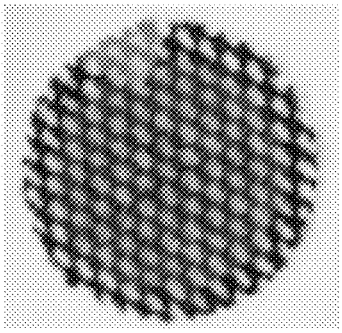
FIG. 6*a* is a photographic diagram of the polytetrafluoroethylene textile comprising 75 denier polyester yarns layer, 200 denier polytetrafluoroethylene structural layer and 20 denier spandex yarns layer with the weight ratio of 61:37:2 after 50,000 wear resistant revolutions.
Figure 6B:
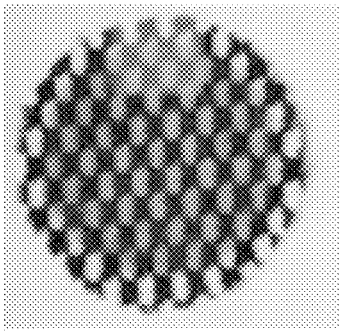
FIG. 6*b* is a photographic diagram of the polytetrafluoroethylene textile comprising 70 denier nylon yarns layer and 200 denier polytetrafluoroethylene structural layer with the weight ratio of 38:62 after 40,000 wear resistant revolutions.

The characteristic of the abrasion resistance of the aforementioned polytetrafluoroethylene textile was measured by the following methods: performing the ASTM D4966 friction test standard by a Martindale Abrasion Tester; rubbing the polytetrafluoroethylene textile with a woven fiber cloth with wool material according to a certain rotation track (Lissajous Figure: Lee's graphics); and evaluating the number of the wear resistant revolutions of the polytetrafluoroethylene textile, that is the rotation number of the wear resistant revolutions of the fabric due to friction when the broken yarns or hole of the test sample is produced. The polytetrafluoroethylene textiles after the abrasion resistance test are shown in FIG. 6*a* and FIG. 6*b*, wherein FIG. 6*a* is a photographic diagram of the polytetrafluoroethylene textile comprising 75 denier polyester yarns layer, 200 denier polytetrafluoroethylene structural layer and 20 denier spandex yarns layer with the weight ratio of 61:37:2 after 50,000 wear resistant revolutions, and FIG. 6*b* is a photographic diagram of the polytetrafluoroethylene textile comprising 70 denier nylon yarns layer and 200 denier polytetrafluoroethylene structural layer with the weight ratio of 38:62 after 40,000 wear resistant revolutions. As can be seen in FIG. 6*a* and FIG. 6*b*, the polytetrafluoroethylene textile of the present invention has a high degree of abrasion resistance.

Figure 7A:
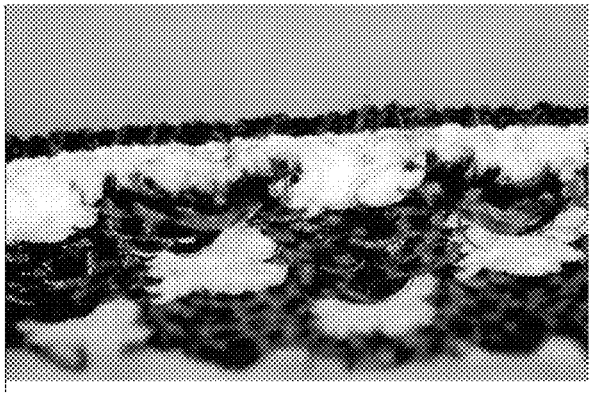
FIG. 7*a* is a photographic diagram of the knit-assisting part of the present invention.
Figure 7B:
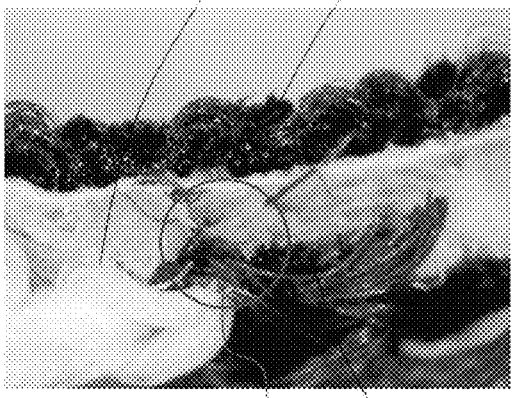
FIG. 7*b* is an enlarged diagram of FIG. 7*a*.
Figure 8:
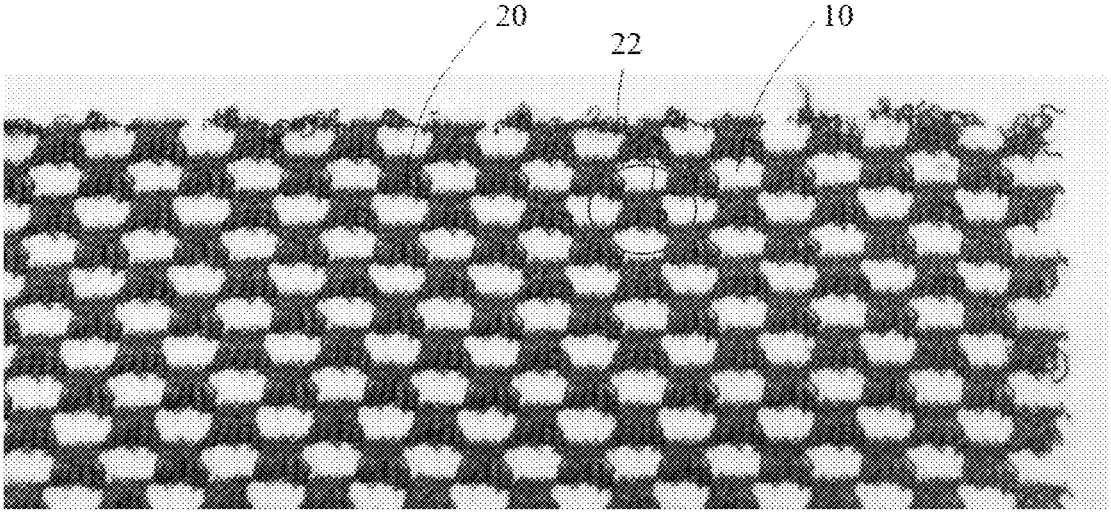
FIG. 8 is a top view of polytetrafluoroethylene textile of the present invention.

In the polytetrafluoroethylene textile of the present invention, the polytetrafluoroethylene structural layer 20 has at least one knit-assisting parts 22. Referring to FIG. 7*a*, FIG. 7*b* and FIG. 8, FIG. 7*a* is a photographic diagram of the knit-assisting part of the present invention; FIG. 7*b* is an enlarged diagram of FIG. 7*a*; and FIG. 8 is a top view of polytetrafluoroethylene textile of the present invention. As shown in FIG. 7*a*, FIG. 7*b* and FIG. 8, the polytetrafluoroethylene structural layer 20 has the knit-assisting parts 22 for assisting knitting the polytetrafluoroethylene yarns and the artificial yarns together and confining the artificial yarns correspondingly to thereby obtain the polytetrafluoroethylene textile of the present invention. For example, the knit-assisting parts 22 can be an expanded structure, which is fluffy, curled and twisted in shape, and formed on the polytetrafluoroethylene yarns, and the artificial yarns of the artificial structural layer 10 can be configured to pass through the polytetrafluoroethylene yarns to thereby knit with the at least two of the polytetrafluoroethylene yarns. The knit-assisting part 22 can be manufactured by the aforementioned pretreatment process S10, but not limited thereto. By performing the pretreatment process S10 to make the polytetrafluoroethylene yarns of the polytetrafluoroethylene structural layer 20 have the knit-assisting parts 22, the artificial yarns of the artificial structural layer 10 can be knitted with the polytetrafluoroethylene yarns of the polytetrafluoroethylene structural layer 20 more easily via the knit-assisting parts 22, and the artificial structural layer 10 and the polytetrafluoroethylene structural layer 20 can be strongly knitted together. All regions or partial regions of the polytetrafluoroethylene structural layer 20, namely, all regions or partial regions of polytetrafluoroethylene yarns, can have the knit-assisting parts 22, and the knit-assisting parts 22 can be regularly or irregularly distributed on the polytetrafluoroethylene structural layer 20. And, users can adjust the positions of the knit-assisting parts 22 depending on actual needs.

In addition, as shown in FIG. 8, FIG. 8 is a top view of polytetrafluoroethylene textile of the present invention. The polytetrafluoroethylene yarns of the polytetrafluoroethylene structural layer 20 and the artificial yarns of the artificial structural layer 10 can be knitted and regularly patterned. By designing the knitting location of the polytetrafluoroethylene yarns and the artificial yarns, the pattern style of the polytetrafluoroethylene structural layer 20 can be designed depending on actual needs. And, because of the low friction characteristic of the polytetrafluoroethylene yarns, the characteristics of low cost, high permeability and abrasion resistance can be achieved by designing the knitting pattern of the polytetrafluoroethylene yarns and then knitting with the artificial structural layer 10 without knitting with the artificial yarns comprehensively.

In summary, in the polytetrafluoroethylene textile and the manufacturing method thereof of the present invention, the polytetrafluoroethylene textile with characteristics of high durability and permeability can be manufactured by knitting the polytetrafluoroethylene yarns and the artificial yarns together. And, the pretreatment process, which has a first knitting process, is performed before performing the second knitting process to make the polytetrafluoroethylene yarns have the knit-assisting parts to thereby facilitate knitting the polytetrafluoroethylene yarns and the artificial yarns together, and even confining the artificial yarns correspondingly. Therefore, the structure of the polytetrafluoroethylene textile manufactured by the method of the present invention is strong. Moreover, the abilities of waterproofing and moisture permeation of the polytetrafluoroethylene textile can be improved by performing the laminating process to laminate the water repellent fabric with the polytetrafluoroethylene textile together. And, the manufactured polytetrafluoroethylene textile has excellent characteristics of moisture-proof, water resistance and water repellent by using specific materials and specifications of the artificial yarns.

While the invention has been described by way of example(s) and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of manufacturing a polytetrafluoroethylene textile, comprising steps of:

performing a pretreatment process on a plurality of polytetrafluoroethylene yarns, wherein the pretreatment process comprises a step of extending the polytetrafluoroethylene yarns; a step of first knitting the polytetrafluoroethylene yarns obtained by the step of extending the polytetrafluoroethylene yarns into a polytetrafluoroethylene fabric; a step of fixing the shape of the polytetrafluoroethylene fabric; and a step of de-knitting the polytetrafluoroethylene fabric obtained by the step of fixing the shape of the polytetrafluoroethylene fabric; and performing a second knitting process to knit the polytetrafluoroethylene yarns obtained by the step of de-knitting the polytetrafluoroethylene fabric and a plurality of artificial yarns together to obtain the polytetrafluoroethylene textile.

2. The method of claim 1, wherein the length of the polytetrafluoroethylene yarns are increased in a proportion of 70% to 120% in the step of extending the polytetrafluoroethylene yarns.

3. The method of claim 2, wherein the length of the polytetrafluoroethylene yarns are increased by pulling and twisting in the step of extending the polytetrafluoroethylene yarns, and the polytetrafluoroethylene yarns obtained by the step of de-knitting the polytetrafluoroethylene fabric have a twisting value ranged from 150 to 650 TPI.

4. The method of claim 2, wherein in the step of extending the polytetrafluoroethylene yarns the length of the polytetrafluoroethylene yarns are increased by pulling and twisting at a temperature ranged from 230 to 260 Celsius degrees, and the polytetrafluoroethylene yarns obtained by the step of de-knitting the polytetrafluoroethylene fabric have a twisting value ranged from 150 to 650 TPI.

5. The method of claim 1, wherein the shape of the polytetrafluoroethylene fabric is fixed by heating in the step of fixing the shape of the polytetrafluoroethylene fabric.

6. The method of claim 5, wherein the shape of the polytetrafluoroethylene fabric is fixed by heating the polytetrafluoroethylene fabric at a temperature ranged from 230 to 260 Celsius degrees in the step of fixing the shape of the polytetrafluoroethylene fabric.

7. The method of claim 1, wherein a twisting value of the polytetrafluoroethylene yarns obtained by the step of de-knitting the polytetrafluoroethylene fabric is ranged from 150 to 650 TPI.

8. The method of claim 1, further comprising performing a laminating process to laminate a water repellent fabric with the polytetrafluoroethylene textile together.

9. The method of claim 1, wherein the artificial yarns are selected from a group consisting of nylon yarns, polyester yarns and spandex yarns, the denier of the polytetrafluoroethylene yarns being within a range of from 40 to 400 denier, the denier of the nylon yarns being within a range of from 20 to 280 denier, the denier of the polyester yarns being within a range of from 20 to 300 denier, the denier of the spandex yarns being within a range of from 15 to 70 denier.

10. The method of claim 9, wherein a weight ratio of the nylon yarns to the polytetrafluoroethylene yarns is within a range of 25-45:55-75 if the artificial yarns are the nylon yarns, and a weight ratio of the polyester yarns to the polytetrafluoroethylene yarns to the spandex yarns is within a range of 50-65:34-40:1-10 if the artificial yarns is consisted of the polyester yarns and the spandex yarns.

11. A polytetrafluoroethylene textile manufactured according to the method as claimed in claim 1, comprising:

an artificial structural layer comprising a plurality of artificial yarns; and a polytetrafluoroethylene structural layer comprising a plurality of polytetrafluoroethylene yarns, wherein the polytetrafluoroethylene yarns obtained by the step of de-knitting the polytetrafluoroethylene fabric and the artificial yarns are knitted together in the step of performing the second knitting process.

12. The polytetrafluoroethylene textile of claim 11, further comprising a water repellent structural layer disposed on the artificial structural layer, and wherein the water repellent structural layer and the polytetrafluoroethylene structural layer are disposed on two opposite sides of the artificial structural layer respectively.

13. The polytetrafluoroethylene textile of claim 11, wherein the polytetrafluoroethylene yarns obtained by the step of de-knitting the polytetrafluoroethylene fabric have a twisting value ranged from 150 to 650 TPI.

14. The polytetrafluoroethylene textile of claim 11, wherein the artificial structural layer is selected from a group consisting of nylon yarns layer, polyester yarns layer and spandex yarns layer.

15. The polytetrafluoroethylene textile of claim 14, wherein the denier of the polytetrafluoroethylene yarns is within a range of from 40 to 400 denier, the denier of nylon yarns of the nylon yarns layer is within a range of from 20 to 280 denier, the denier of polyester yarns of the polyester yarns layer is within a range of from 20 to 300 denier, the denier of spandex yarns of the spandex yarns layer is within a range of from 15 to 70 denier.

16. The polytetrafluoroethylene textile of claim 14, wherein a weight ratio of the nylon yarns layer to the polytetrafluoroethylene structural layer is within a range of 25-45:55-75 if the artificial structural layer is the nylon yarns layer, and a weight ratio of the polyester yarns layer to the polytetrafluoroethylene structural layer to the spandex yarns layer is within a range of 50-65:34-40:1-10 if the artificial structural layer is consisted of the polyester yarns layer and the spandex yarns layer.

* * * * *